United States Patent [19]

Groen et al.

[11] 4,161,904

[45] Jul. 24, 1979

[54] LIQUID PROPELLANT MODULAR GUN INCORPORATING HYDRAULIC PRESSURIZATION OF THE CASE

[75] Inventors: William Groen, San Jose; Lester C. Elmore, Portola Valley, both of Calif.

[73] Assignee: Pulsepower Systems, Incorporated, San Carlos, Calif.

[21] Appl. No.: 803,442

[22] Filed: Jun. 6, 1977

[51] Int. Cl.[2] ..... F41F 1/04

[52] U.S. Cl. ..... 89/7; 89/11

[58] Field of Search ..... 89/7, 9, 11, 12, 172, 89/185

[56] References Cited

U.S. PATENT DOCUMENTS

| | | | |
|---|---|---|---|
| 3,800,657 | 4/1974 | Broxholm et al. | 89/7 |
| 4,062,266 | 12/1977 | Elmore et al. | 89/7 |

*Primary Examiner*—David H. Brown

*Attorney, Agent, or Firm*—Donald C. Feix

[57] ABSTRACT

A liquid propellant modular gun has a main cam which is driven at a multiple of the gun firing rate and which has internal cam surfaces operatively associated with the bolt while the bolt is driven forward to load and fire and backward to accept another projectile.

The gun incorporates a control cam driven at the gun firing rate and effective to unlock the bolt after firing of a projectile so that the bolt can be returned to its rearward position under the control of the main cam.

The main cam acts to time all the remaining mechanisms of the gun to the bolt motion.

The accelerating force for the bolt is provided by hydraulic pressure applied directly to the bolt area.

Energy stored in the bolt from the force of the accelerating hydraulic pressure is converted into rotary energy and is stored in the main cam and other rotating devices geared to the main cam.

The stored rotary energy in the main cam is used in combination with residual gas pressure remaining in the gun barrel for a part of the bolt return stroke to accelerate the bolt rearward.

Energy losses, including those caused by hydraulic pressure drop, friction and windage, are made up by a pumping system receiving its energy from the gas pressure added to the gun as a part of the firing of each projectile.

32 Claims, 9 Drawing Figures

FIG.2
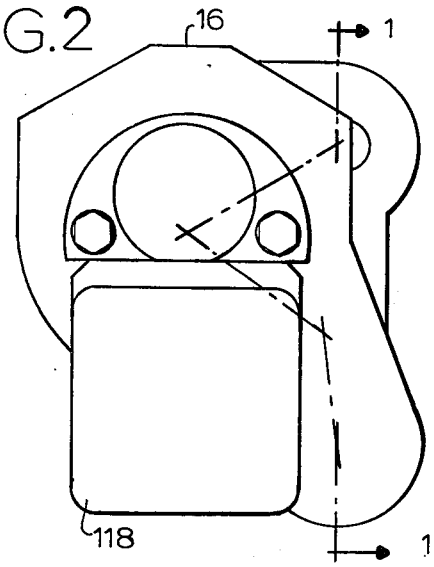
FIG.5
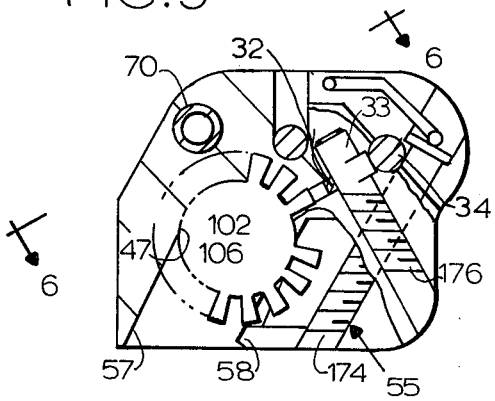
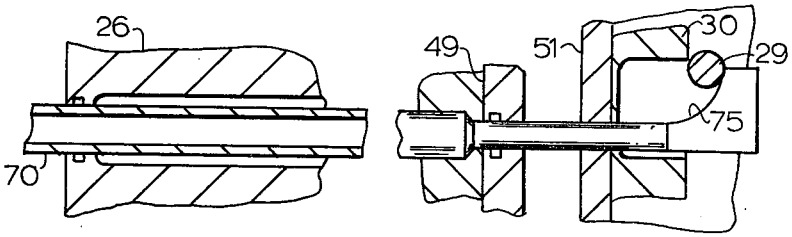
FIG.6
FIG.7
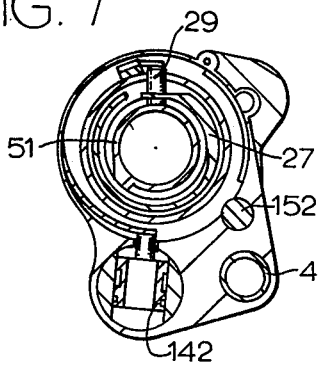
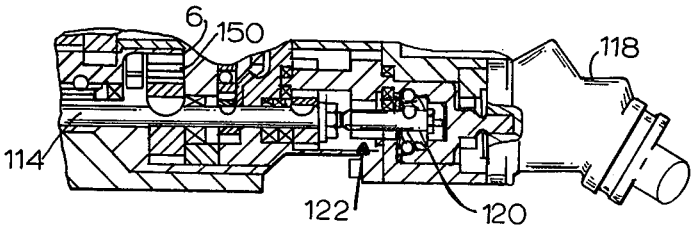
FIG. 9
FIG.8
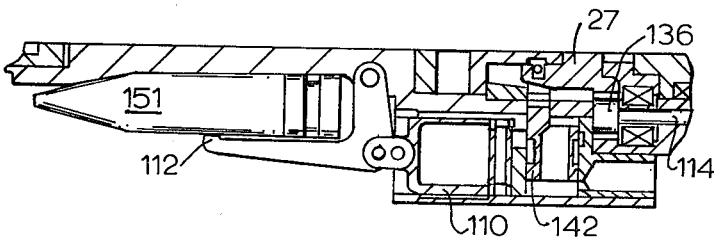

LIQUID PROPELLANT MODULAR GUN INCORPORATING HYDRAULIC PRESSURIZATION OF THE CASE

CROSS REFERENCES TO RELATED APPLICATIONS

This invention relates to a liquid propellant gun of the kind disclosed in issued U.S. Pat. Nos. 3,800,657; 3,915,057; 3,949,642; 3,919,922; and 3,998,129 to Broxholm et al. and pending U.S. patent application Ser. No. 616,822 filed Sept. 25, 1975 by Elmore et al and now U.S. Pat. No. 4,062,266 (all assigned to the same assignee as the assignee of this application).

BACKGROUND OF THE INVENTION

This invention relates to a modular liquid propellant gun of the kind in which liquid propellant is burned in a combustion chamber to fire a projectile from the gun.

The liquid propellant guns disclosed in the five issued U.S. Patents and pending U.S. patent application referred to above are representative of the prior art, and the present invention relates to certain improvements in a liquid propellant gun of this general kind.

SUMMARY OF THE INVENTION

The liquid propellant gun of the present invention is a hydraulically operated, externally-driven gun constructed in modular form. A main cam serves to time all operations to the bolt motion, to decelerate the bolt during its loading stroke and to accelerate the bolt during its opening stroke.

The gun mechanism is so housed that it can be grouped in multiple units, either in a circular or flat configuration, to give a multi-barrel gun.

A hydraulic motor is used on each module to provide rotary power for driving the gun mechanism. The motor drives a main cam and a control cam by means of gears off a jackshaft.

The main cam operates at a multiple of the gun firing rate and has internal cam grooves of the Yankee screwdriver configuration which are associated with a cam follower on the bolt during forward motion of the bolt to load and fire and during backward motion of the bolt to accept another projectile.

The bolt is locked at the end of the forward motion by rotating the bolt to place locking lugs on the head of the bolt behind mating lugs in the barrel.

The bolt is maintained in this locked position throughout the propellant loading and firing portion of the cycle and is then unlocked by a control cam rotating in the reverse direction from the main cam. The control cam operates at the gun firing rate and urges the bolt cam follower pin into the return groove of the main cam.

The main cam also has a rest groove in which the bolt cam follower pin rides when the gun is not firing.

The gun repeats the firing operation (loading a new projectile into the bolt pathway as soon as the bolt reaches its fully retracted position) in an automatic mode of operation unless the bolt is locked in the fully retracted position.

In the present invention the main cam acts to time all the mechanisms of the gun to the motion of the bolt.

The main cam also serves, to some extent, to drive the bolt during certain portions of the movement of the bolt, but the primary function of the main cam is synchronization of the bolt movement with other gun mechanisms.

The power required to accelerate and to drive the bolt and projectile forward into the gun barrel is quite high during automatic operation of the gun. To obtain this high peak power efficiently the present invention applies hydraulic pressure directly to the bolt area. When the bolt is unlocked, this hydraulic pressure drives the bolt and projectile forward so that the main cam, during this part of the cycle of operation, does not provide the accelerating force for the bolt and projectile.

The bolt must be slowed to a low velocity at the end of the forward stroke, and the main cam is used to provide this slowing of the bolt during the last half of its stroke. This result is obtained by increasing the cam groove angle so that the energy stored in the bolt from the accelerating hydraulic pressure is transferred through the bolt follower to the main cam and is converted into rotary energy which is stored in the main cam and all the other rotating devices geared to the main cam.

The firing rate of the gun is dependent upon the average speed of the main cam and the control cam geared to it. In one particular embodiment of the present invention, the main cam operates initially at 3,000 rpm and the control cam operates initially at 600 rpm to provide a firing rate of 1,000 rounds per minute.

The hydraulic pressure used to drive the bolt forward not only smooths cyclic peak loads, but it also supplies lubrication to the entire drive assembly of the gun since the entire mechanism is sealed in an oil bath by the present invention.

After firing, the bolt cam follower is rotated to the unlocked position by a control cam as noted above.

At this point, the present invention utilizes residual gas pressure in the barrel to force the bolt rearward and to position the bolt cam follower in the return groove in the main cam.

The stored rotary energy in the main cam is then used, in addition to the residual gas pressure remaining in the barrel, for a part of the stroke to accelerate the bolt rearward.

The energy stored in the main cam would return the bolt to its starting position after it is unlocked if the losses (including those caused by hydraulic pressure drop, friction and windage and the kinetic energy in the projectile) were negligible. However, these losses are large enough to require a significant addition of power to the hydraulic system from an external power source. In accordance with the present invention, a gas operated hydraulic pumping system (which receives its energy from the gas pressure added to the gun as a part of the firing of each projectile) is employed to provide the additional energy required during each firing cycle rather than requiring the main hydraulic system power source to supply it.

The present invention also embodies a timing cam driven at the same speed as the control cam. The timing cam serves as a lock-out device to allow the bolt release only during the appropriate portion of the cycle. The timing cam synchronizes the bolt unlock operation with the control cam position. That is, since the main cam turns at a multiple of the gun firing rate, the forward groove of the main cam passes the bolt cam follower a number of times before the timing for the release of the bolt is correct with respect to the control cam. The timing cam provides the required synchronization of the bolt release into the forward groove of the main cam.

A torsion bar is used to provide a constant locking torque on the bolt to effect the necessary radial motion of the bolt in a sufficiently short time. The torsion bar provides a high spring force to rotate the bolt into a locked position at the end of the bolt forward stroke.

A single valve arrangement is used for controlling the flow of propellant to the combustion chamber of the gun. The valve is associated with a projectile sensor mechanism in a manner such that the propellant valve is maintained closed until a projectile has actually entered the gun as determined by the actuation of the projectile sensor mechanism.

The propellant valve must then be opened rapidly. The valve is opened by the forward motion of the bolt, to provide the required fast opening of the valve, and is held opened during the propellant filling portion of the cycle by a cam pin in the control cam. The propellant valve also provides isolation of the propellant supply from the gun combustion chamber during firing. The projectile sensor mechanism forces a sliding member to the end of its travel against a spring load as a projectile enters the gun from the feed belt. This motion forces a sear hook attached to the propellant valve into the path of a locking lug on the bolt head. The forward motion of the bolt then can engage the propellant valve and open it.

The projectile sensor mechanism thus ensures that, if no projectile enters the gun, no propellant is admitted to the gun.

The projectile sensor mechanism is also effective to prevent the gun module from being disabled by a misfire cam if no projectile enters the gun from the feed belt.

The present invention incorporates a multi-purpose misfire detection mechanism which uses the gas pressures added to the gun upon the firing of each projectile for two purposes—to pump make up fluid and to operate the misfire detection.

As noted above, these gas pressures are used to pump hydraulic fluid to make up energy losses.

The present invention uses a piston and rod assembly as part of this pumping mechanism.

The piston and rod assembly also operates a disable cam to disable the gun module in the event of a misfire.

The mechanism used to lock the bolt in its most rearward position incorporates a ball lock device which is controlled by a plunger operated by a solenoid or by the application of hydraulic pressure directly to the plunger.

The belt which feeds projectiles and which surrounds the gun module or gun modules is caused to rotate as soon as the gun module or modules are put into the ready condition. The drive for this mechanism is obtained from the same hydraulic motor (or motors) which drives the individual gun module (or associated gun modules).

The drive connection between the hydraulic motor and the belt includes harmonic drive gearing to provide a large gear reduction with a minimum of mechanism bulk and weight.

The hydraulic motor in each gun module drives the main cam of the gun module, as described above; and the main cam is geared to an output shaft through the harmonic drive gearing. The shaft in turn is geared to the belt containing the projectiles.

Thus, the belt surrounding the modules serves to synchronize the firing of the modules and serves also to drive the projectile feed to the gun modules.

Liquid propellant gun apparatus and methods which incorporate the structure and techniques described above and which are effective to function as described above constitute specific objects of this invention.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWINGS

FIG. 2 is an end elevation view of the gun shown in FIG. 1 and is taken in the direction indicated by the arrows 2—2 in FIG. 1.

FIG. 5 is a cross section view taken along the line and in the direction indicated by the arrows 5—5 in FIG. 1. FIG. 5 is partly broken away to show details of a projectile presence sensor lug 58 and helical rack 55.

FIG. 6 is a fragmentary cross section view taken along the line and in the direction indicated by the arrows 6—6 in FIG. 5. FIG. 6 shows details of a misfire detection cam 75 and its association with the gas operated rod 70 of FIG. 4.

FIG. 7 is an elevation view in cross section taken along the line in the direction indicated by the arrows 7—7 in FIG. 1.

FIG. 8 is a fragmentary side elevation view in cross section through a portion of the gun shown in FIG. 1 and shows details of the drive to the control cam and the hydraulic piston and hammer assembly for loading projectiles.

FIG. 9 is a fragmentary side elevation view in cross section taken along the same plane as FIG. 8 showing details of the drive to the main cam.

DESCRIPTION OF THE PREFERRED EMBODIMENTS

Figure 1:
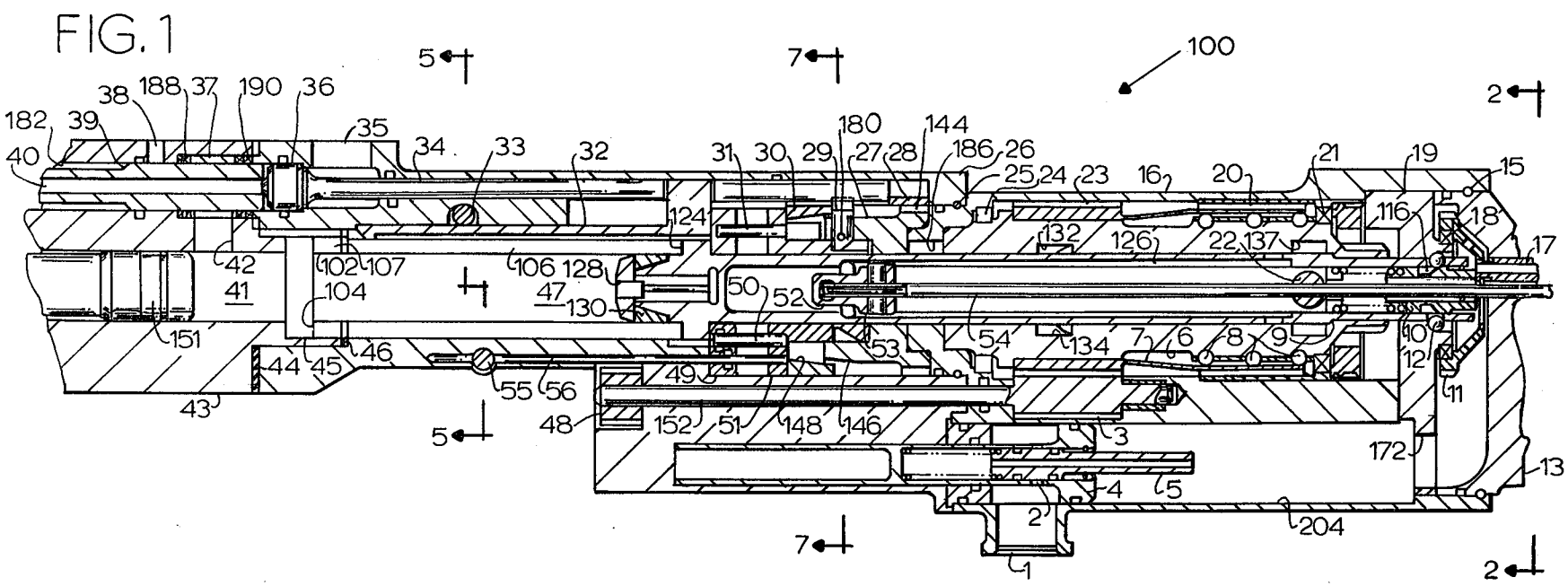
FIG. 1 is a fragmentary side elevation view in cross section of a liquid propellant gun constructed in accordance with one embodiment of the present invention. The section of FIG. 1 is taken along the line and in the direction indicated by the arrows 1—1 in FIG. 2.

A liquid propellant gun module constructed in accordance with one embodiment of the present invention is indicated generally by reference numeral 100 in FIG. 1.

The liquid propellant modular gun 100 is a hydraulically driven, cam synchronized mechanism that fires a caseless, liquid monopropellant round. The gun module construction provides for flexible, modular installation with several modules grouped to use a single feed system. The gun module can be utilized as an in-row grouping or as clustering in a circular pattern.

Each module is self-contained and is independent of all others when used in a multi-module configuration, and synchronization between modules is obtained by gearing each module to a common projectile feed system. In the multi-module configuration the modules are timed so that they fire successively and at equal intervals, thus providing integrated, multi-barrel operation. The gun of the present invention includes a misfire detection feature that disables one module in case of a misfire while permitting the remaining modules in a banked row or cluster to continue to fire.

The gun module 100 includes as principal components a barrel 43, a barrel extension 26 and a drive assembly housing 16 which supports the components in the drive assembly.

The gun module 100 also includes the following listed numbered elements, each of which is described in greater detail in the text following the listing.

| DRAWING REFERENCE NUMERAL | GUN MODULE STRUCTURAL ELEMENT | DRAWING REFERENCE NUMERAL | GUN MODULE STRUCTURAL ELEMENT |
|---|---|---|---|
| 1. | Hydraulic system pressure port | 18. | Timing cam bearing |
| 2. | Transfer piston valve port | 19. | Support |
| 3. | Harmonic drive output pinion | 20. | Harmonic drive internal gear |
| 4. | Transfer piston | 21. | Main cam rear bearing |
| 5. | Transfer piston valve | | |
| 6. | Main cam | 22. | Bolt cam follower |
| 7. | Flexspline | 23. | Flexspline output gear |
| 8. | Harmonic drive elliptical cam balls | | |
| 9. | Bolt | 24. | Main cam forward bearing |
| 10. | Bolt lock piston | | |
| 11. | Timing cam | 25. | Retainer ring |
| 12. | Bolt lock balls | 26. | Barrel extension |
| 13. | Drive chamber end | 27. | Control cam |
| 14. | High pressure gas inlet port | 28. | Propellant valve arc cam |
| 15. | Retainer ring | 29. | Control cam pin |
| 16. | Drive assembly housing | 30. | Control cam lock ring |
| 17. | Bolt lock release plunger | | |
| 31. | Propellant valve disable push pin | 49. | Drive chamber plug |
| 32. | Propellant valve sear hook | 50. | Pin cam actuating rod |
| 33. | Propellant valve sear hook cam | 51. | Pin cam |
| 34. | Propellant valve stem | 52. | Torsion bar head |
| 35. | Propellant inlet port | 53. | Torsion bar pins |
| 36. | Propellant valve head | 54. | Torsion bar |
| 37. | Blocking slide sleeve | 55. | Projectile sensor |
| 38. | Vent port | 56. | Pin cam locking rod |
| 39. | Blocking slide | | |
| 40. | Blocking slide vent port | 57. | Projectile entry port |
| 41. | Gun chamber | 58. | Projectile sensor lug |
| 42. | Gun chamber propellant inlet port | | |
| 43. | Barrel | 59. | Vent port |
| 44. | Insulation | 60. | Retainer ring |
| 45. | Bolt locking lug relief groove | 61. | Gas pump spring retainer plug |
| 46. | Insulation | 62. | Gas pump spring |
| 47. | Projectile receiver bore in barrel extension | 63. | Gas pump override hydraulic piston |
| 48. | Projectile drive gear train pinion | 64. | Gas pump hydraulic fluid chamber |
| 65. | Rifled barrel | 107. | Guide grooves for the bolt lugs in the barrel |
| 66. | Gas pump hydraulic | | |

-continued

| DRAWING REFERENCE NUMERAL | GUN MODULE STRUCTURAL ELEMENT | DRAWING REFERENCE NUMERAL | GUN MODULE STRUCTURAL ELEMENT |
|---|---|---|---|
| | fluid piston | | |
| 67. | Retainer ring | 108. | Projectile sensor torsion bar spring |
| 68. | Gas pump piston stop | | |
| | | 109. | Projectile sensor spring arm |
| 69. | Vent port | | |
| 70. | Gas pump piston rod | 110. | Projectile loading piston |
| 71. | Gas pump piston | 112. | Projectile loading hammer |
| 72. | Gas pump piston sealing rings | 114. | Jackshaft |
| 73. | Gas pump rod sealing rings | 116. | Bolt rest position locking means |
| 74. | Gas pump high pressure gas chamber | 118. | External rotary hydraulic drive motor |
| 75. | Disable cam | 120. | Overriding clutch |
| 100. | General reference to the liquid propellant modular gun module | 122. | Gearing |
| 102. | Bolt locking lugs in barrel | 124. | Locking lugs on the bolt |
| 104. | Bolt lug locking surfaces in the barrel | 126. | Grooves for torsion rod pins |
| 106. | Bolt lug slideways for bolt lugs in the barrel extension | 128. | Precombustion chamber |
| 130. | Chamber breech seal | 161. | Conduit |
| 132. | Rearward groove for bolt cam follower | 162. | Sequence valve |
| 134. | Forward groove for bolt cam follower | 164. | Selector valve |
| 136. | Driving pinion for control cam | 166. | Sequence valve spool |
| 137. | Rear rest groove for bolt cam follower | 168. | Inlet port |
| | | 170. | Restrictor check |
| 142. | Control valve for projectile loader | 171. | Outlet port |
| 144. | Gear on control cam | 172. | Passageway |
| 146. | Locking taper | 174. | Helical rack |
| 148. | Locking taper | 176. | Helical gear teeth |
| 150. | Idler gear | | |
| 151. | Projectile | 180. | Cantilever spring |
| 152. | Shaft | | |
| 156. | Muzzle switch actuator | 182. | Chamber |
| 158. | Gun system accumulator | 184. | Chamber |
| 160. | Check valve | 186. | Groove |
| 190. | Metalic rings | | |
| 192. | Gas pump fluid passageway | | |
| 194. | Gas pump fluid exit cavity | | |
| 196. | Check valve | | |
| 204. | Transfer piston bore | | |
| 206. | Check valve | | |

The barrel 43 provides 60 or more calibers of projectile travel and includes a combustion chamber 41, a propellant fill port blocking slide 39 with its hydraulic spring, an optional water purge valve (not illustrated, but basically like the purge valve illustrated in FIGS. 26, 27 and 28 of the above referred to pending U.S. Pat. application Ser. No. 616,822), breech closure locking lugs 102 having bolt locking surfaces 104, and a gas inlet port 14 near the muzzle communicating with a sensing piston 71.

The barrel 43 is attached to the barrel extension 26 by means of three, close fitting, self-locking pins (not illustrated) which provide a quick disconnect means to remove the barrel and to thermally isolate the barrel from the remainder of the gun by providing either an air gap between the barrel and the barrel extension or insulation 44 and 46.

Since the locking lugs are a part of the barrel 43, breech loads caused by combustion chamber pressure are absorbed by the barrel 43 and are not transmitted to the rest of the mechanism. This permits a lightweight structure for the remaining parts of the gun since the remaining parts must only support their own dynamic and fluid pressure loads.

The barrel extension 26 contains slideways 106 for the bolt 9, the propellant filling valve 36, the projectile presence sensor 55 with its torsion bar spring 108 and arm 109, and the projectile loading means 110 and 112. In addition, the barrel extension 26 provides a housing for a control cam 27, a disable cam mechanism 75, and a support for the projectile feed mechanism which includes a projectile feed belt (not illustrated, but basically like that shown in FIGS. 2, 5, and 31 through 39 of the above noted pending patent application Ser. No. 616,822).

Drive assembly housing 16 contains all the mechanisms for driving the gun. These include a main cam 6, the gearing 3, 23, 7 and 8 for driving the projectile feed system, the transfer mechanism, including a transfer piston 4 for supplying hydraulic pressure to drive the bolt 9 forward, the jackshaft 114 for driving the main cam 6 and the control cam 27, the bolt rest position locking means 116, the torsion bar bolt lock 54, an optional triggering solenoid (not illustrated) and a synchronization cam 11. The drive assembly in addition provides support for an external hydraulic motor 118 and an overriding clutch 120 and gearing 122.

In one specific embodiment of the present invention the bolt 9, which is basically cylindrical in shape, has sixteen locking lugs 124 projecting radially near the forward end of the bolt and a cam follower pin 22 projecting radially near the back end of the bolt. Internally, the bolt contains a pair of grooves 126 engaging torque pins 53 which provide the torque required to lock the bolt into the barrel when the bolt reaches its forward position.

The bolt nose contains a spark igniter (not illustrated), a precombustion chamber 128, and a chamber breech seal 130.

A ball latch mechanism 12 is incorporated in the rear end of the bolt to lock the bolt to the housing during the rest period.

The main cam 6 is an internal cylindrical type with two grooves 132 and 134 which trace bi-directional spiral paths similar to a Yankee screwdriver. The main cam 6 permits the cam follower 22 to rest at each end of its travels until urged back into the grooves 132, 134 by external means. The rear end of the cam 6 has a simple 360° annular groove 137 into which the grooves 132, 134 blend. At the forward end one cam groove 134 expels the follower 22 into a cavity in the drive assembly housing 16 and the other groove 132 accepts the follower 22 when the follower 22 is forced into the groove 132 by a ramp on the control cam for retraction of the bolt.

In one particular embodiment of the present invention the cam 6 is initially driven constantly by the hydraulic motor 118 through the gear train at 3 times gun firing rate, i.e. when the gun is firing at 1000 rounds per minute, the main cam is rotating initially at 3000 rpm. This speed provides approximately an 11 millisecond bolt extension time, 22 millisecond forward dwell, 14 millisecond bolt retraction time after firing, and a 13 millisecond rear dwell time for projectile loading while the gun is firing.

The cam 6 provides a three-fold purpose in the operation of the gun.

First, since the bolt is driven forward by hydraulic pressure in the drive assembly housing, the cam provides no power during the first half of the stroke. Then during the last half of the forward stroke, the cam decelerates the bolt to near zero velocity (as will be described in greater detail below) and converts the energy absorbed by the bolt into rotational energy stored in the cam and other rotating gun mechanisms.

Second, during the return stroke this energy is returned to the bolt (less losses). If there were no losses, the bolt would be returned to its starting position and all the energy expended by the hydraulic system would be recovered. Since there are losses, the losses are made up by the external power source (gas operated piston 66) as will also be described in greater detail below.

The third function of the main cam 6 is to synchronize the bolt operation with the other mechanisms of the gun.

The control cam 27 revolves about the bolt 9 just forward of the main cam 6 and is driven by a gear 136 on the jackshaft 114 at an average speed equal to the gun firing rate. Thus, the control cam 27 operates at a submultiple of the speed of the main cam 6 and rotates in the opposite direction. A small ramp on the rear face of the control cam 27 engages the bolt cam follower 22 at the proper time to urge the cam follower 22 into the return path 132 of the main cam 6.

A pin 29 projects radially from the control cam 27 and serves several purposes. The pin 29 locks the propellant valve 36 in its open position for the time required to fill the combustion chamber 41 with propellant. The pin 29 engages the disable cam 75 in the event a misfire occurs and the cam 75 is not retracted by the piston rod 70. The pin 29 operates the valve 142 controlling the hydraulic mechanism 110 driving the projectile loading hammer 112.

If a misfire occurs, the pin 29 engages the misfire cam 75 and pulls the control cam 27 forward. This disengages the gear 144 on the control cam 27 from the jackshaft pinion 136 and stops the rotation of the control cam. The inertia of the control cam forces a locking taper 146 on the exterior surface of the control cam into engagement with a matching taper 148 in a lock ring 30 attached to the barrel extension. This locks the control cam 27 in its full forward position. The forward motion of the control cam 27 can also be used to open an optional water purge valve (not illustrated) and to force the propellant loading valve 36 forward far enough to provide an exit passageway for the propellant and water into the gun chamber in the manner illustrated and described in FIGS. 26, 27 and 28 of the above referred to pending patent application Ser. No. 616,822.

The gun module 100, in a specific embodiment of the present invention, is triggered by an electrical signal to a solenoid (not illustrated in the drawings) connected to a lock plunger 17.

Since the main cam 6 operates at a multiple of gun speed, a locking or timing cam 11 operating at gun speed is used to prevent the lock plunger 17 from retracting until the main cam 6 is in the proper position with respect to the control cam 27 position. Retraction of the lock plunger 17 allows the ball latch 12 to release the bolt 19, and hydraulic pressure on the bolt diameter forces the bolt forward.

The drive mechanism 16 utilizes the hydraulic motor 118 to drive all the rotary motions in the gun module 100.

The motor 118 drives through an overriding clutch 120 and a small gear box 122 directly into the jackshaft 114. The jackshaft 114, operating at a multiple of gun speed, in turn is geared to the main cam 6 through an idler gear 150 and drives the control cam 27 at its forward end directly at gun speed. In addition, the locking or timing cam 11 is operated by the jackshaft 114 through the same reduction as the reduction to the control cam 27.

As indicated above, the average speed of the main cam throughout a cycle is a given rpm, such as, for example, 3000 rpm. However, in order to store the energy transferred from the bolt 9 during the deceleration of the bolt, the main cam 6 speeds up. In order to prevent the hydraulic motor 118 from dissipating this energy as heat in its constant speed hydraulic control, an overriding clutch 120 is used. Thus, the only time power is being absorbed from the hydraulic motor 118 is when the main cam 6 slows down during the return stroke of the bolt to less than its initial speed of 3000 rpm. The peak power required from the hydraulic motor is only required for a few milliseconds during bolt retraction in a gun cycle. At all other times during the cycle the motor operates at considerably less than the peak power to overcome friction and windage losses in the rotating members.

The projectiles 151 are rotating about the gun module 100 and are held in a circular chain or belt containing the projectile containers. To drive this system a harmonic gear train is used. The exterior surface of the main cam 6 provides a cammed surface for driving a flexible inner gear (called the flexspline 7) of the harmonic drive gear train through a ball drive 8. The mating internal gear 23 is located in the drive assembly housing 16. A take off pinion 3 on shaft 152 engages the output gear 23 of the flexspline and drives the projectile retainer mechanism (not illustrated) through projectile drive gear train pinion 48.

The projectile feed system in each gun module 100 comprises a hammer 112 which forces the projectile 151 out of the conveyor and into the barrel extension 26 through a slot 57. The hammer 112 is controlled by a piston 110 in a cylinder contained in a barrel extension 26. The cylinder is designed to apply system hydraulic pressure to the rod side of the piston 110 at all times, thus providing the retraction force required when the head side is connected to return. When it is desired to force a projectile 151 into the module, the spool of a three-way valve 142 is moved to admit fluid pressure to the head side of the piston 110. The areas of the two sides are arranged to provide the extension force required. The valve spool 142 in turn is controlled by the cam pin 29 in the control cam 27 which moves the valve spool at the proper time in the firing cycle.

Figure 3:
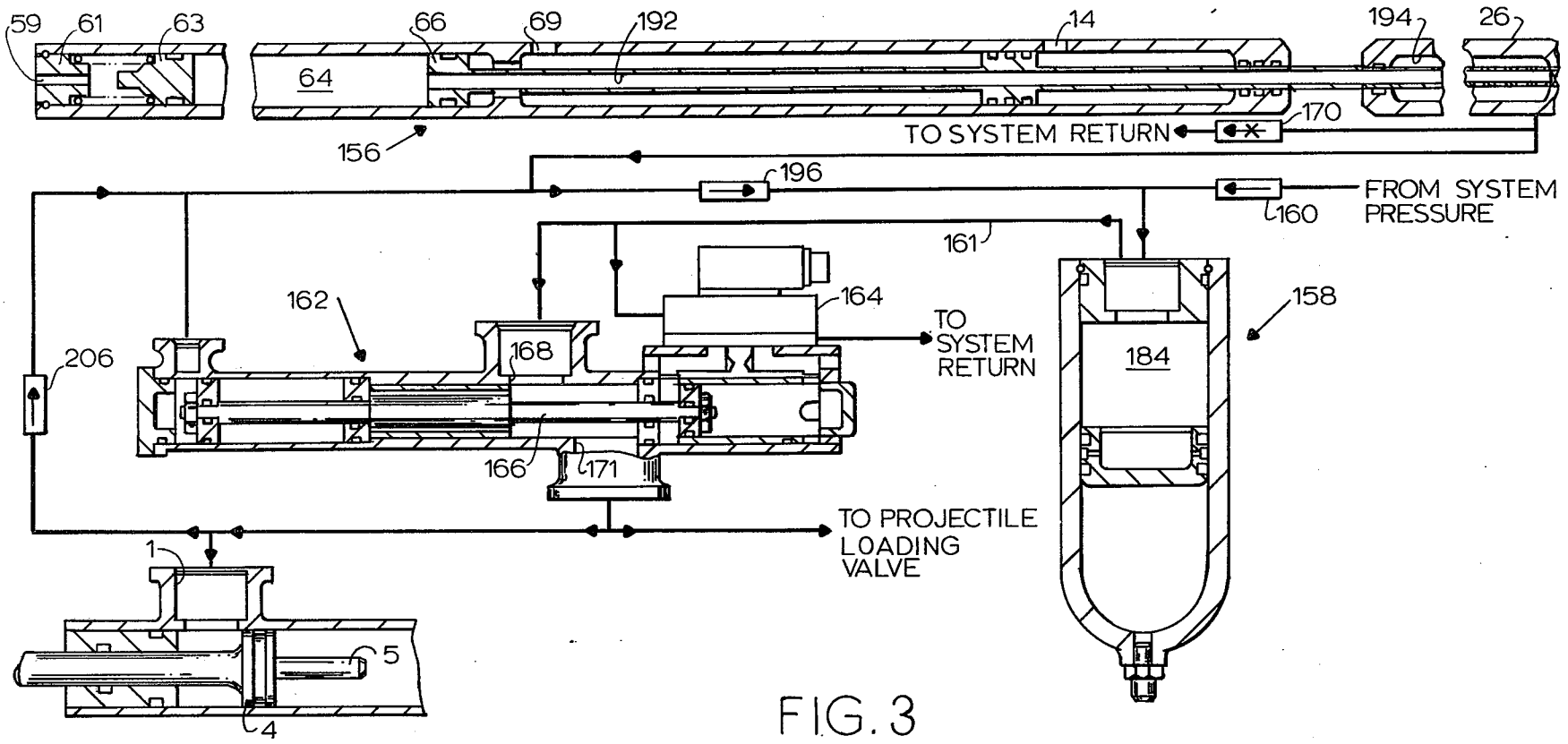
FIG. 3 is a schematic, partly in cross section, of a hydraulic system associated with the gun of FIG. 1.

FIG. 3 is a schematic of the external hydraulic system used to supply hydraulic power to each gun module 100.

The muzzle switch actuator 156 used to replenish the hydraulic power required to drive the bolt 9 and the transfer piston 4 used to pressurize the gun module 100 are shown schematically in FIG. 3 although both these mechanisms are physically located in the gun module 100.

System hydraulic pressure is supplied to the gun system accumulator 158 through a check valve 160 and from the accumulator 158 through a conduit 161 to the inlet of a sequence valve 162 and an electrically operated selector valve 164. When system pressure is applied to the gun system all of these valves are pressurized as well as the hydraulic motor 118 which drives the rotating members in the gun module 100 at a constant speed (subject to accelerating forces supplies by forward movements of the bolt 9 as described above). In addition, pressurization of the selector valve 164 forces the spool 166 of the sequence valve 162 to the right closing the inlet port 168 and thus blocking system pressure from the gun transfer piston 4 and the hydraulic fluid chamber 64 of the muzzle switch actuator 156. The pressure in these chambers is reduced to return system pressure since they are always connected to return through a restrictor check 170.

In operation, and referring to FIGS. 1 and 3, when the gun module 100 is placed in the "ready" condition, the hydraulic motor 118 is running and driving the main cam 6 and the control cam 27 and the timing cam 11 at their initial speeds (3000 rpm and 600 rpm respectively in one specific embodiment of the present invention), and the hydraulic motor 118 is also rotating the projectile feed system around the gun module and is driving the projectile supply system (both not illustrated) through the harmonic drive gearing.

The transfer piston 4 is at the left (as viewed in FIGS. 1 and 3) end of its travel, the bolt 9 is locked in the fully retracted position shown, the muzzle switch piston 66 is at the right end of its travel, and the chamber 64 is filled with hydraulic fluid. The sequence valve slide 166 is at the right (as viewed in FIG. 3) end of its travel and has closed off system hydraulic pressure to the gun module 100 as described above; and the accumulator 158 is pressurized to system pressure.

When the firing trigger switch and a second switch (not illustrated) on the timing cam 11 are closed, the selector valve 164 on the sequence valve 162 moves the sequence valve slide 166 to the left (as viewed in FIG. 3) to open the passageway from the inlet port 168 to the outlet port 171 connected to the hydraulic inlet port 1 of the gun.

The hydraulic pressure inlet port 1 is now pressurized, and this pressurizes the interior of the drive housing 16 by means of the hydraulic pressure applied to transfer piston 4. This tends to move the transfer piston 4 to the right (as viewed in FIG. 1), and the pressure is transmitted within the barrel extension 26 as far as the plug 49.

Pressurization of the drive housing 16 produces a load on the lock plunger 17 tending to force the lock plunger 17 to the right against a spring (not shown). The lock plunger 17 is prevented from moving by the timing cam 11 until the control cam 27 is in the proper angular position for the bolt to start its forward motion. When the lock plunger does move to the right, the lock piston moves to the right to let the balls 12 drop into the groove 116, and this releases the ball lock on the bolt so that the bolt can be moved forward by the hydraulic pressure.

The pressurization of the drive housing 16 provides a force on the bolt 9 tending to force the bolt to the left, but it is prevented from moving by the ball lock mechanism which locks the bolt to the support 19. As noted above, the lock piston 10 is held at the left end of its stroke by the plunger 17 against the load of a spring. A series of balls 12 located in radial holes in the bolt 9 surround the lock piston and are held outward far enough to project from the outside diameter of the bolt. These lock the bolt to the support 19. As soon as the timing cam 11 releases the plunger 17, the plunger moves to the right and the locking piston follows. The locking balls 12 drop into the groove 116 in the piston and now are below the outside diameter suface of the bolt 9. This frees the bolt from the support.

Hydraulic pressure now forces the bolt to the left, and the bolt follower 22 is forced into the forward cam groove 134 of the main cam 6.

Hydraulic fluid now flows into the hydraulic pressure inlet port 1 and into the chamber on the rod side of the transfer piston 4. The transfer piston now moves to the right forcing the fluid out of the chamber on its head side, through the passageway 172 shown in the end cap 13 into the drive housing 16.

The displacement of the transfer piston 4 is equal to that of the bolt plus any leakage of fluid from the housing 16.

Makeup of any fluid losses is done with the valve 5. If leakage has occurred, the piston 4 will be displaced farther than normal. Toward the end of its stroke the stem of the valve 5 will contact the closure 13 and further motion of the piston 4 will open the valve 5. Hydraulic fluid can now flow from the port 1 through the valve port 2 into the bore on the head side of the piston 4. The piston 4 is now forced to the left until the valve closes and shuts off the flow.

As the bolt 9 accelerates to the left (as viewed in FIG. 1), the angle of the cam forward groove 134 is kept at such a value that no contact with the bolt cam follower 22 is made. The main cam 6 continues to rotate at its initial angular velocity of 3000 rpm. At approximately 3.7 inches of the bolt's total travel of 7.3 inches (in one specific embodiment of the present invention) sufficient kinetic energy has been transferred from the hydraulic system to the bolt 9 to overcome the losses during the remainder of the cycle. The angular inclination of the cam groove 134 is now steepened. This applies a retarding force on the cam follower 22 and the bolt which slows the bolt to near zero velocity just before bolt locking occurs. The kinetic energy transferred from the bolt to the main cam 6 now increases the angular velocity of the main cam and the angular velocity of all other rotating members geared to the main cam 6. The hydraulic motor 118 continues to operate at its initial speed since the overriding clutch 120 in series with the drive permits the driven members to overspeed.

The locking lugs 124 at the head end of the bolt are located in mating grooves 106 in the barrel extension 26. These grooves are also shown in FIG. 5.

Just before the bolt 9 started its forward motion a projectile 151 was forced from the feed belt through the passageway 57 into the receiver bore 47. The entry of the projectile 151 forces the projectile sensor 55 upward when the projectile 151 strikes the lug 58.

As the bolt starts its forward stroke the pin cam locking rod 56 can now follow under the influence of the hydraulic pressure in the housing 16 since it is no longer locked in place by projectile sensor 55. In addition pin cam actuating rod 50 which was held in its rearward position by the bolt locking lug can now move forward under the same hydraulic pressure load. This movement forces pin cam 51 forward until pin 50 strikes its stop. The forward motion of pin cam 51 extends control cam pin 29 at the proper time so that it may perform its functions listed above.

The projectile sensor has a helical rack 174 on one side which engages helical gear teeth 176 on the cam 33. Upward motion of the projectile sensor causes rotation of the cam 33 and forces sear hook 32 into the pathway of a locking lug 124 on the bolt 9. Thus, the sear hook 32 is forced to the left (as viewed in FIG. 1) when the lug 124 strikes the sear hook 32. The sear hook, in turn, is attached to the propellant valve stem 34 and forces the propellant valve 36 to the left when the lug 124 strikes the sear hook 32. Leftward movement of propellant valve stem 34 and propellant valve 36 opens a passageway from the propellant inlet port 35 to combustion chamber inlet port 42.

When the bolt 9 returns, the projectile sensor 55 is forced downward by torsion bar spring 108 through arm 109 onto the rod 56 after the bolt 9 passes the projectile sensor 55. The locking lug 124 on the bolt contacts the pin 50 near the end of its stroke forcing the pin 50 and the pin cam 51 and the rod 56 to the right (as viewed in FIG. 1) returning them to their original positions. When the rod 56 is fully retracted, the projectile sensor 55 drops to its initial position as illustrated in FIG. 5 and locks rod 56 and thus pin cam 51 in their original positions.

Since a pin 29 is located in the control cam 27, the pin 29 is rotating about the bolt 9 and can be extended radially at the proper time by the cam surface on the pin cam 51 which is not rotating. Thus, the functions of the pin 29 and the module disable and propellant valve timing operation are controlled by the motion of the pin cam 51. The pin 29 is held radially inward against the pin cam 51 by a cantilever spring 180 shown as a round cross section through the pin 29 in FIG. 1.

As indicated above, the bolt 9 forces the propellant valve 36 to the left when a locking lug 124 strikes the sear hook 32.

As the projectile 151 which forced the sensor 55 upward moves out from under the lug 58, the lug passes onto the surface of the bolt, and this holds the sensor 55 in the retracted position. The sear hook 32 therefore remains in the position required to engage the bolt 9. As the propellant valve 36 moves toward the left, it also forces the blocking slide 39 to the left. This forces hydraulic fluid in the chamber 182 to the left of the blocking slide into a hydraulic spring chamber in the gun barrel 43 and provides a high return force required to close the propellant valve 36 at the end of the propellant filling portion of the cycle.

During its entire stroke to the left, the bolt 9 has a high torque applied in a clockwise sense when viewed from the right end of the gun module 100 in FIG. 1. This torque is provided by the torsion bar 54 through two torque pins 53 which ride in the grooves 126 cut in the inside diameter of the bolt. These pins, in turn, are guided in the bore and retained by the torque head 52. When the bolt reaches the end of its stroke, the locking lugs 124 on the bolt are forced out of the guide grooves 107 in the barrel 43, which grooves match the grooves 106 in the barrel extension 26, and the locking lugs 124 pass into a relief groove 45 in the barrel 43.

At the same time the cam follower 22 in the bolt is expelled from the forward groove 134 in the main cam 6 and exits into a groove 186 in the housing 16.

The bolt 9 is now free to rotate in a clockwise direction (as viewed from the right end of the gun module 100 in FIG. 1) under the influence of the torsion bar 54. The groove 186 in the housing 16 is limited in length and stops the bolt rotation at 11.25° in one specific embodiment of the present invention. The locking lugs 124 on the bolt are now behind the locking lugs 102 in the barrel 43, and the bolt is prevented from being forced to the right (backward as viewed in FIG. 1 by the gas pressure which is generated in the barrel 43 when firing occurs.

As the bolt 9 and the propellant valve 36 reach their forward position, the pin 29 is forced outward by the pin cam 51, and the pin 29 passes behind an arc cam 28 which is attached to the propellant valve shaft 34.

The propellant valve 36, which is no longer retained by the sear hook 32 after the bolt has been rotated to lock, is now prevented from closing under the influence of the hydraulic spring force acting on the blocking slide 39. The pin 29 holds the valve 36 open for that portion of the cycle required for propellant filling. The projectile 151 which has been positioned to the left of the port 42 by the bolt 9 is now forced further to the left in the gun chamber 41 by the propellant entering the combustion chamber through the ports 35 and 42. Propellant flows through the port 35, past the propellant valve 36, into the gun chamber 41 through the port 42.

When the projectile 151 reaches the forcing cone (not illustrated) in the gun barrel, it stops and the propellant flow stops.

At this time the pin 29 in the control cam 27 has passed from behind the arc cam 28; and the propellant valve 36 and the blocking slide 39 move to the right and close the port 42.

The gun chamber is now sealed by the bolt and the blocking slide by high pressure seals on these members. The blocking slide moves in the sleeve 37 which retains the sealing members in a mating bore in the barrel. The high pressure gas in the chamber 41, after firing, forces elastomeric seals at the ends of the sleeve 37 outward against a pair of metallic rings 190. These rings 190 have matching 45° taper surfaces at their interface, and thus one ring is forced outward and the other inward under the influence of the gas pressure. The rings being forced inward seal the outside diameter of the blocking slide while those being forced outward seal the bore for the sleeve in the barrel. Should the seals on the right end of the sleeve leak, the space between the propellant valve head 36 and the blocking slide 39 will become pressurized. Since the propellant valve is prevented from moving to the right by a shoulder on the valve head which mates with a counterbore in the barrel extension 26, the blocking slide 39, in the event of leakage of gas, is forced to the left against the hydraulic spring pressure, and the blocking slide opens a vent port 40 to the space between the two members which was sealed by the conical seal on the propellant head. This movement allows leakage gas to escape without building up high gas pressure on the propellant valve head 36. A leak through the seal at the left end of the sleeve passes out through the vent port 38.

Isolation of the main propellant supply from the firing chamber 41 in the gun is accomplished by the mechanism described above. As the valve 36 moves to the right to close, the valve 36 forces the propellant behind the valve head back into the barrel extension 26. The barrel extension 26 is thermally isolated from the gun barrel 43 by insulation 44 and 46 between the members.

The locking lugs 102 on the barrel 43 are located in a cylindrical extension of the barrel, and this extension fits into a mating counterbore in the barrel extension 26 as illustrated. A small air gap (not shown in the drawings) is maintained between these members at this point and serves as insulation. The only direct connection between the two members is through three close fitting pins (as described above) which lock the members together.

Ignition of the liquid propellant charge is accomplished by electric spark ignition in the precombustion chamber 128 located in the bolt head. This ignites the propellant in the gun chamber 41, and the pressure in the gun chamber 41 forces the projectile 151 past the forcing cone and through the barrel 43.

Figure 4:
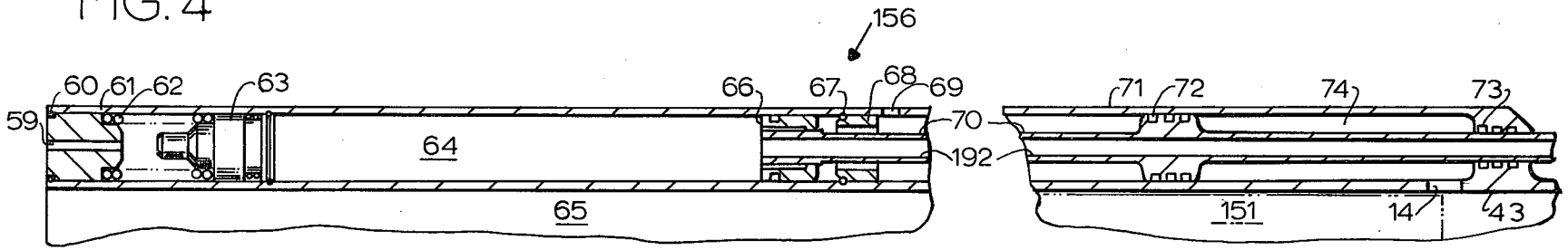
FIG. 4 is a fragmentary side elevation view in cross section of a muzzle switch actuator physically incorporated in the gun module of FIG. 1 but also shown as a part of the hydraulic system of FIG. 3.

After burning has been completed, further travel of the projectile expands the gases in the gun chamber 41 and the pressure decreases. When the pressure has been decreased to approximately 20,000 psi (in one specific embodiment of the present invention) a port 14 (See FIG. 4.) is passed by the projectile 151 and opens the chamber 74 in the muzzle switch to the right of the piston 71 to the pressure in the gun barrel 43. The pressure is prevented from escaping past the piston rod 70 and piston head 71 by high pressure seals 73 and 72 respectively. The force generated by the gas pressure forces the piston 71 to the left (as viewed in FIG. 4), and the piston 66 in the chamber 64 which is filled with hydraulic fluid is also forced to the left.

This motion of the pistons 71 and 66 forces the fluid in the chamber 64 through the passageway 192 in the rod 70 and forces piston 63 to the left until stopped by plug 61. The high pressure fluid passes from this passageway 192 through a cavity 194 in the barrel extension (See FIG. 3.) where the fluid exits the gun module 100.

The fluid closes the restrictor check valve 170 and passes through a second check valve 196 in the free-flow direction into the gun system accumulator 158. The pressure also drives the sequence valve spool 166 to the right, if the selector valve 164 (which was reversed during the propellant fill portion of the cycle by a switch on the timing cam) has not completed the shutoff stroke of the sequence valve spool 166.

The movement of the sequence valve spool 166 shuts off the pressure port 168 from the gun port 1.

The gas piston 71 moves to the left until it strikes the stop 68 retained by the ring 67.

Any gas pressure escaping past the seal rings 72 is vented through the port 69.

When the piston 71 bottoms, the hydraulic pressure in passageway 192 and chamber 64 decays to return pressure since the passageway in the rod 70 is connected to the return system through a small orifice in the now closed restrictor check 170. The decay in pressure allows the restrictor check 170 to open which increases the size of the orifice. The piston 63 can now move to the right under the influence of the spring 62 forcing its displaced oil out the restrictor check 170.

The gun incorporates a mechanism which disables the gun module 100 in case a misfire occurs. See FIG. 6. This is accomplished by placing a cammed surface 75 in the path of the pin 29 in the control cam 27. If the gun fires, this cam 75 is retracted out of the path of the pin 29 by the piston 71 through the rod 70. The rod 70 extends into the cavity occupied by the control cam 27 and has the disable cam surface 75 attached to its end.

If the gun misfires and the cammed surface 75 is not retracted, the pin 29 strikes the surface 75 forcing the pin 29 and the control 27 to the left, as viewed in FIG. 1. This motion disengages the gear on the control cam 27 from the driving pinion 136 on the jackshaft 114 and stops the rotation of the control 27.

The inertia of the control cam 27 carries the control cam to the left, as viewed in FIG. 1, until the taper 146 on the cam nose locks into the mating taper 148 of the lock ring 30 which now prevents any further motion of the control cam 27.

The bolt 9 which normally would be unlocked by the rotation of control cam 27 remains locked.

The leftward motion of the control cam 27 also forces the pin 31 to the left which, in turn, forces the propellant valve 36 to the left far enough to connect the port 42 to the intersection between the valve head 36 and the blocking slide 39. In this event a water valve (not) illustrated) is also opened by the motion of the control cam 27 to admit high pressure water to the gun chamber 41 at the base of the projectile 151. The water then forces the liquid propellant and water out the vent port 38.

Assuming that a normal firing takes place and the gun module 100 is not disabled, the bolt 9 is unlocked by the rotation of the control cam 27. A ramp on the control cam 27 engages the bolt cam follower pin 22 and rotates the bolt cam follower pin 22 until the locking lugs 124 in the bolt head are disengaged from the mating lugs 102 in the barrel 43.

Since the residual pressure in the barrel 43 is still high and the return groove 132 in the main cam 6 is in line with the follower 22, the bolt 9 is accelerated to the right (as viewed in FIG. 1) and the follower 22 enters the return cam groove 132.

The inclination of the cam groove 132 is such that the rotational energy in the main cam 6 is now translated into an accelerating force on the bolt 9. Thus, initially, both the residual pressure in the gun chamber 41 acting on the bolt area and the force of the main cam 6 accelerate the bolt 9 to the right. After approximately 0.6 inches of bolt travel the residual pressure has decreased to zero and no longer provides force. The main cam 6 now provides the only accelerating force.

The bolt motion displaces hydraulic fluid from the interior of the drive chamber 16 into the bore 204 in which the transfer piston 4 slides. The piston 4 moves to the left (as viewed in FIG. 1) displacing fluid out of the port 1.

Referring to FIG. 3, it will be noted that this fluid cannot pass through the sequence valve 162 since the sequence valve 162 is still closed. The fluid must pass through the check valve 206. The fluid cannot pass through the check valve 196 since the check valve 196 is held closed by the system pressure. Check valve 170 is closed by the high flow rate of the fluid exiting port 1.

The fluid is forced into the chamber 64 through the passageway 192 in the rod 70. Since during the first 0.6 inch of bolt travel the residual pressure in the gun barrel 43 and thus in the chamber 74 is still high, the fluid entering the chamber 64 cannot force the piston 66 to the right. Therefore, the oil displaces the piston 63 to the left against the force of the spring 62. When the piston 63 has reached the end of its stroke, the residual pressure has decayed to a low value, and further displacement of the bolt 9 will result in forcing the piston 66 to the right.

The bolt 9 proceeds to the right accelerated by the main cam 6. When the angular velocity of the main cam 6 has been reduced to its initial value, the hydraulic motor 118 is again engaged through the overriding clutch 120 and adds its power to return the bolt. The cam angle of the "return" groove 132 in the main cam 6 is changed at this time so that energy is no longer transferred to the bolt 9 from the main cam 6. The bolt now proceeds to the end of its travel opposed by the force generated by the pressure drop of the exiting fluid and by friction forces and reaches the rest groove 136 in the main cam at near zero linear velocity.

As the bolt 9 is retracting, piston 66 is moving toward the right; and as the bolt 9 nears the end of its stroke and its velocity is reduced, the pressure in the chamber 64 (which reflects the pressure drop of the returning oil from the transfer piston 4) is also reduced. Thus, near the end of the stroke, the pressure in the chamber 64 is low enough that the spring 62 can force the piston 63 to the right to the end of its travel. Therefore, when the bolt reaches the rest groove 137, all the fluid which was displaced is once again restored to the chamber 64 (with the exception of that which was lost to the return system through the restrictor check 170).

The makeup fluid required is replenished as soon as the sequence valve 162 opens the pressure port 168 to the gun module. The slide 166 is moved to the left at the end of the bolt return stroke by reversal of the selector valve 164 admitting pressure to the gun port 1.

Fluid can now flow into the chamber 64 from system pressure.

The piston 63 is forced to the left again to await the next firing cycle.

If the trigger has been released during the cycle, the selector valve 164 on the sequence valve 162 is deenergized by the timing cam 11 at the proper point in the cycle. The spool 166 in the valve 162 is forced to the right closing off pressure to the gun module 100.

The pressure in the system decreases to return pressure, and the plunger 17 is now urged to the left by a spring. The timing cam 11 prevents the plunger from moving until the bolt has reached its fully retracted position. The plunger then moves to the left forcing the locking piston 10 to the left and extending the lock balls 12 behind the shoulder of the support 19, thus locking the bolt 9.

As indicated above, the projectile feed mechanism is geared to the main cam 6 and thus is driven by the hydraulic motor 118. The gearing is arranged in a manner known as a harmonic drive. This type of drive consists of a flexible, external gear which engages the teeth of a fixed internal gear when the flexible external gear is deflected by an elliptical cam on its interior surface. Thus, as the elliptical cam rotates, the two points at which the flexible member, known as a spline, engage the internal gear rotate with the cam. If the spline now has two teeth less than the fixed internal gear, the spline will advance two teeth for each revolution of the cam. A third gear attached to the spline can now be used to drive the external mechanism which in this case is the projectile feed.

The elliptical cam is machined as three ball races at the right end of the main cam 6. See FIG. 1. The balls 8 are held in these elliptical grooves by a suitable ball separator member and by the inside diameter of the flexible spline 7. The spline is shown in engagement with the fixed internal gear 20 which also provides a support for the bearing 21 which in turn supports the main cam.

Thus, as the main cam 6 turns, the points of engagement of the spline in the fixed internal gear rotate about the main cam 6. As explained above, the spline now rotates at a gear ratio equal to one-half the number of teeth in the internal gear.

The output gear 23 is an integral part of the flexible spline and rides on a bearing surface at the left end of the main cam 6.

A pinion gear 3 is driven by the gear 23 and drives one of the gears 48 in the feed mechanism gear train through a shaft supported by the barrel extension 26.

The gun module 100 of the present invention thus provides a number of features including:

a. A method to drive the bolt directly with hydraulic pressure and still retain the Yankee screwdriver type main cam to control the bolt;
b. A timing cam for synchronizing the bolt release with the position of the control and thus the forward groove of the main cam;
c. A torsion bar, bolt-locking system;
d. A propellant valve opened by the bolt motion which provides isolation of the propellant supply from the gun chamber during firing and which also provides the necessary rapid opening of the propellant valve;
e. A projectile sensing device which prevents propellant from being pumped into the gun chamber and which also prevents the gun module from being disabled if a projectile is not loaded;
f. A piston and rod assembly that senses that firing has occurred and that uses the gas pressure generated to pump high pressure hydraulic fluid back into the supply system to make up the energy expended during the bolt forward stroke. This same piston and rod assembly operates the disable cam;
g. A ball locking device to lock the bolt in its most rearward or bolt open position when the gun is not firing; and
h. A harmonic drive gear mechanism to provide power to the projectile feed system.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. A liquid propellant gun of the kind in which liquid propellant is burned in a combustion chamber to fire a projectile from the gun and comprising, a bolt mounted for axial movement between a rearward, projectile loading position and a forward, projectile firing position, and drive assembly means for reciprocating the bolt between the rearward and forward positions, said drive assembly means including drive mechanism for driving the gun and an outer case constructed to provide a sealed enclosure about the bolt and the drive mechanism and fluid pressurizing means for conducting high pressure hydraulic fluid to the interior of the case and directly against the back surfaces of the bolt to drive the bolt forward by the forces produced by the high pressure fluid action on the rear surfaces of the bolt within the outer case and to provide lubrication for all internal moving parts of the drive mechanism within the outer case.

2. The invention defined in claim 1 including a propellant injection control valve for controlling the injection of liquid propellant into the combustion chamber and wherein the valve is operatively associated with the bolt so that the valve is opened by forward movement of the bolt.

3. The invention defined in claim 1 wherein the fluid pressurizing means include a transfer piston for transferring pressure from a source of high pressure fluid independent of the gun to the interior of said case.

4. The invention defined in claim 3 including sequence valve means operatively associated with said transfer piston for controlling the application of high pressure from said source of high pressure fluid to the transfer piston.

5. The invention defined in claim 1 including liquid propellant injection means for injecting a liquid propellant into the combustion chamber.

6. The invention defined in claim 5 including projectile sensor means for sensing when a projectile has entered the gun and operatively associated with the propellant valve for opening the propellant valve only when a projectile has entered the gun.

7. The invention defined in claim 5 wherein the propellant valve is operatively associated with the bolt so that forward movement of the bolt opens the propellant valve.

8. A liquid propellant gun of the kind in which liquid propellant is burned in a combustion chamber to fire a projectile from the gun and comprising, a bolt mounted for axial movement between a rearward, projectile loading position and a forward, projectile firing position, and drive assembly means for reciprocating the bolt between the rearward and forward positions, said drive assembly means including an outer case and fluid pressurizing means for conducting high pressure fluid to the interior of the case and directly against the back surfaces of the bolt to drive the bolt forward by the forces produced by the high pressure fluid acting on the rear surfaces of the bolt within the outer case and including an accumulator operatively associated with the sequence valve for storing high pressure fluid at the pressure of said source of high pressure fluid after the sequence valve has closed off the source of said high pressure fluid from the accumulator and the liquid propellant gun.

9. The invention defined in claim 8 including gas operated pumping means powered by the gases produced by the firing of the projectile and operatively associated with the sequence valve means and the accumulator for making up during the rearward movement of the bolt energy losses from said fluid pressure incurred during the forward movement of the bolt and the loading of the projectile during each cycle of operation of the gun.

10. A liquid propellant gun of the kind in which liquid propellant is burned in a combustion chamber to fire a projectile from the gun and comprising, a bolt mounted for axial movement between a rearward, projectile loading position and a forward, projectile firing position, and drive assembly means for reciprocating the bolt between the rearward and forward positions, said drive assembly means including an outer case and fluid pressurizing means for conducting high pressure fluid to the interior of the case and directly against the back surfaces of the bolt to drive the bolt forward by the forces produced by the high pressure fluid acting on the rear surfaces of the bolt within the outer case and wherein the drive assembly means include a main cam mounted for rotation within the outer case and operatively associated with the bolt during the forward and rearward reciprocation of the bolt.

11. The invention defined in claim 10 wherein the bolt includes a cam follower engaged with the main cam, the main cam extends parallel to the bolt and has a forward cam groove which receives the bolt cam follower during forward motion of the bolt and wherein the forward cam groove has an angular inclination which causes the cam follower to engage a side of the forward cam groove near the end of the forward motion of the bolt both to decelerate the forward motion of the bolt and at the same time to store energy from the decelerating bolt into the main cam and other structure mounted for rotation with the main cam by converting the deceleration of the axial motion of the bolt into acceleration of the rotary motion of the main cam.

12. The invention defined in claim 11 wherein the main cam includes a return groove which receives the bolt cam follower during rearward motion of the bolt and wherein the angular inclination of the return cam groove causes a side of the return cam groove to engage the cam follower to drive the bolt rearward by the rotary motion of the main cam only during the first part of the rearward movement of the bolt.

13. The invention defined in claim 10 including projectile feed mechanism means for feeding projectiles to the gun and gear means connecting the projectile feed means to the main cam for drive from the rotation of the main cam.

14. The invention defined in claim 13 wherein the gear means include harmonic drive gear reduction gearing for driving the projectile feed mechanism at a much slower speed than the speed of rotation of the main cam.

15. The invention defined in claim 13 including a hydraulic motor connected to drive the main cam.

16. The invention defined in claim 15 including an overrunning clutch in the drive connection between the hydraulic motor and the main cam so that the main cam can rotate faster than the speed of rotation of the hydraulic motor during certain parts of a cycle of operation of the gun.

17. The invention defined in claim 10 wherein the barrel has bolt locking lugs and the bolt has mating locking lugs and the bolt is mounted for limited rotation so that the bolt locking lugs engage the barrel locking lugs when the bolt is rotated to a locked position at the forward end of the stroke.

18. The invention defined in claim 17 including a control cam mounted for rotation within the outer case and engagable with the bolt cam follower for rotating the bolt to an unlocked position after firing.

19. The invention defined in claim 18 including cam drive means in the drive assembly means effective to rotate the main cam at a multiple of the speed of rotation of the control cam and including a timing cam operatively associated with the main and the control cam for synchronizing the entry of the bolt cam follower into the forward groove of the main cam.

20. The invention defined in claim 18 including a pin cam operatively associated with the control cam for controlling the injection of propellant into the gun.

21. The invention defined in claim 20 including a propellant inlet valve and wherein the pin cam includes a pin operatively associated with the propellant inlet valve for holding the propellant inlet valve open for the amount of time required to fill the firing chamber of the gun with liquid propellant.

22. A liquid propellant gun of the kind in which liquid propellant is burned in a combustion chamber to fire a projectile from the gun and comprising, a bolt mounted for axial movement between a rearward, projectile loading position and a forward, projectile firing position, and drive assembly means for reciprocating the bolt between the rearward and forward positions, said drive assembly means including an outer case and fluid pressurizing means for conducting high pressure fluid to the interior of the case and directly against the back surfaces of the bolt to drive the bolt forward by the forces produced by the high pressure fluid acting on the rear surfaces of the bolt within the outer case and including gas operated motor means powered by the gases produced upon firing of a projectile from the gun and including a movable piston powered by said gases to provide a plurality of functions.

23. The invention defined in claim 22 wherein the piston pumps hydraulic fluid to make up on the return stroke of the bolt fluid pressure and energy losses incurred during forward movement of the bolt during each cycle of operation of the gun.

24. The invention defined in claim 22 wherein the gun includes an external hydraulic circuit and a control valve for controlling the supply of the fluid pressure to the drive assembly and wherein the piston is operatively associated with the control valve to operate the control valve on each firing cycle of the gun.

25. The invention defined in claim 22 including misfire detection means and wherein the piston operates the misfire detection means to disable the gun module in the event of a misfire.

26. A liquid propellant gun of the kind in which liquid propellant is burned in a combustion chamber to fire a projectile from the gun and comprising, a bolt mounted for axial movement between a rearward, projectile loading position and a forward, projectile firing position, and drive assembly means for reciprocating the bolt between the rearward and forward positions, said drive assembly means including an outer case and fluid pressurizing means for conducting high pressure fluid to the interior of the case and directly against the back surfaces of the bolt to drive the bolt forward by the forces produced by the high pressure fluid acting on the rear surfaces of the bolt within the outer case and including a gun barrel having barrel locking lugs, bolt locking lugs on the bolt, and torsion rod bolt locking means for rotating the bolt and bolt locking lugs into locking engagement with the barrel locking lugs at the end of the forward movement of the bolt.

27. A liquid propellant gun of the kind in which liquid propellant is burned in a combustion chamber to fire a projectile from the gun and comprising, a bolt mounted for axial movement between a rearward, projectile loading position and a forward, projectile firing position and mounted for rotary movement between a locked position and an unlocked position, a barrel having barrel locking lugs, bolt locking lugs on the bolt, and torsion rod bolt locking means for rotating the bolt and the bolt locking lugs into locked engagement with the barrel locking lugs at the end of the forward movement of the bolt.

28. A liquid propellant gun of the kind in which liquid propellant is burned in a combustion chamber to fire a projectile from the gun and comprising, a bolt mounted for axial movement between a rearward, projectile loading position and a forward, projectile firing position, liquid propellant injection means for injecting a liquid propellant into the combustion chamber, said liquid propellant injection means including a propellant control valve and propellant control valve opening means attached to the propellant control valve and mechanically engageable with the bolt at a certain point in the forward travel of the bolt to physically move the propellant control valve to an open position as the bolt travels to its full forward position wherein the bolt is operatively associated with the propellant control valve to open the propellant control valve by the forward movement of the bolt.

29. A liquid propellant gun of the kind in which liquid propellant is burned in a combustion chamber to fire a projectile from the gun and comprising, a bolt mounted for axial movement between a rearward, projectile loading position and a forward, projectile firing position, liquid propellant injection means for injecting a liquid propellant into the combustion chamber, said liquid propellant injection means including a propellant control valve and bolt engaging means for moving the control valve to an open position when engaged by the bolt, and wherein the projectile sensor means are operatively associated with the bolt engaging means for the propellant control valve to open the propellant control valve only when a projectile has actually entered the gun.

30. A liquid propellant gun of the kind in which liquid propellant is burned in a combustion chamber to fire a projectile from the gun and comprising, a bolt mounted for axial movement between a rearward, projectile loading position and a forward, projectile firing position, liquid propellant injection means for injecting a liquid propellant into the combustion chamber, said liquid propellant injection means including a propellant control valve which must be open to inject propellant into the combustion chamber, projectile sensor means for opening the propellant control valve only when the projectile enters the gun, an operative connection between the bolt and the propellant control valve effective to open the control valve by the forward movement of the bolt, and ball lock means for retaining the bolt in a rearward, locked position until the start of a firing cycle.

31. A liquid propellant gun of the kind in which liquid propellant is burned in a combustion chamber to fire a projectile from the gun and comprising, a bolt mounted for axial movement between a rearward, projectile loading position and a forward, projectile firing position, drive assembly means for reciprocating the bolt between the rearward and forward positions, said drive assembly means including a main cam mounted for rotation and operatively associated with the bolt during the forward and rearward reciprocation of the bolt, a drive motor for rotating the main cam, projectile feed means for feeding projectiles to the gun, and harmonic drive means including harmonic drive gearing interconnecting the main cam and the projectile feed mechanism for driving the projectile feed mechanism in synchronism with the main cam and effective to drive the projectile feed mechanism from the main cam at a large gear reduction ratio with a minimum of gear mechanism size, said harmonic drive gearing comprising a flexible external gear, a fixed internal gear, and a rotatable elliptical cam engaged with the flexible external gear to cause the points at which the two gears are engaged to rotate with the rotation of the elliptical cam.

32. A liquid propellant gun of the kind in which liquid propellant is burned in a combustion chamber to fire a projectile from the gun and comprising, a bolt mounted for axial movement between a rearward, projectile loading position and a forward, projectile firing position and having a cam follower, drive assembly means for reciprocating the bolt between the rearward and forward positions, said drive assembly means including a main cam having forward and return cam grooves operatively associated with the bolt cam follower for providing part of the drive to the bolt during certain parts of a cycle of operation and for receiving driving motion from and for storing energy from the bolt during other parts of a cycle of operation, a separate control cam for controlling certain events in a cycle of operation of the gun, drive means operatively associated with the drive cam and the control cam for rotating the drive cam at a multiple of the speed of rotation of the control cam, and a timing cam operatively associated with the main cam and control cam for synchronizing entry of the bolt cam follower into the groove of the main cam at the proper times in each cycle of operation of the gun.

* * * * *